United States Patent [19]

Spiegel et al.

[11] 4,305,980

[45] Dec. 15, 1981

[54] ARTIFICIAL TREE

[75] Inventors: Si Spiegel, Briarcliff Manor; Lawrence Squarci, Ravena, both of N.Y.

[73] Assignee: American Technical Industries Inc., New York, N.Y.

[21] Appl. No.: 58,197

[22] Filed: Jul. 17, 1979

[51] Int. Cl.[3] ..... A47G 33/06

[52] U.S. Cl. ..... 428/8; 428/20

[58] Field of Search ..... 428/7–9, 428/18–20

[56] References Cited

U.S. PATENT DOCUMENTS

| | | | |
|---|---|---|---|
| 891,301 | 6/1908 | Spreen | 428/20 |
| 1,689,530 | 10/1928 | Landers | 428/7 |
| 2,149,968 | 3/1939 | Kranz et al. | 428/18 X |
| 2,749,639 | 6/1956 | D'Agnillo | 428/8 |
| 3,223,454 | 12/1965 | Dieffenbach | 300/2 |
| 3,489,462 | 1/1970 | Oakey | 428/18 X |
| 3,548,694 | 12/1970 | Gelardi | 83/596 X |
| 3,594,260 | 7/1971 | Dieffenbach | 428/20 |
| 3,606,472 | 9/1971 | Rutkowski et al. | 428/18 X |
| 3,607,586 | 9/1971 | Hankus | 428/18 |
| 3,634,180 | 1/1972 | De Cosmo et al. | 428/20 |
| 3,647,605 | 3/1972 | Spiegel | 428/18 X |
| 3,665,577 | 5/1972 | Dieffenbach | 428/18 X |
| 3,679,528 | 7/1972 | Spiegel | 428/18 X |
| 3,819,457 | 6/1974 | Mottel | 428/9 |
| 3,829,349 | 8/1974 | Hermanson | 428/20 X |
| 3,839,132 | 10/1974 | Depping | 428/20 X |
| 3,959,536 | 5/1976 | Chase | 428/20 X |
| 3,970,834 | 7/1976 | Smith | 428/20 X |
| 4,101,697 | 7/1978 | Dieffenbach et al. | 428/20 X |

FOREIGN PATENT DOCUMENTS

| | | | |
|---|---|---|---|
| 2109667 | 10/1973 | Fed. Rep. of Germany | 428/20 |

OTHER PUBLICATIONS

American Tree Catalogue ©1980 Div. American Technical Industries, Inc. 24 pp.

*Primary Examiner*—Henry F. Epstein
*Attorney, Agent, or Firm*—Amster, Rothstein & Engelberg

[57] ABSTRACT

There is disclosed a method and apparatus for manufacturing an artificial tree of the type wherein a plurality of stiffly flexible stem members are intertwisted to capture stiffly flexible limb members. The method comprises (a) inserting the limb members between the stem members at spaced predetermined positions, (b) placing a slitted web along the stem members, and (c) intertwisting the stem members to capture the limb members at spaced longitudinal positions and to capture the slitted web. An artificial tree produced by this method has a full, natural appearance. Also disclosed is an apparatus for continuously and automatically performing this method.

7 Claims, 5 Drawing Figures

ARTIFICIAL TREE

BACKGROUND OF THE INVENTION

1. Field of the Invention

The invention relates to the manufacture of artificial trees and more particularly, to the manufacture of artificial trees which are extremely rugged and require little or no assembly time.

2. Description of the Prior Art

Artificial trees have recently come into vogue and in many areas are actually replacing natural trees due to local scarcity of natural trees and the relatively high cost of shipping trees from more plentiful areas.

One type of artificial tree which has attained wide acceptance is that disclosed in U.S. Pat. No. 3,594,260 entitled "Artificial Shrubbery and Method of Manufacturing the Same." The disclosure of this patent is hereby incorporated by reference.

The artificial tree disclosed in the above-identified patent comprises a plurality of limbs held by and generally perpendicularly extending from a rod-shaped stem, the limbs being longitudinally separated from each other along the stem by tubular spacing elements. Each limb comprises a number of filaments or "brush stock" closely resembling the needles of a coniferous tree held by and generally radially extending from a rod-shaped limb body. The limb body comprises a plurality of limb body wires having approximately the same lengths and twisted so that the limb body wires and the filaments are intertwined. The stem comprises a plurality of stem wires having approximately the same lengths. In manufacturing the artificial tree the ends of the stem wires facing in one direction are grasped by a first chuck member such that the stem wires are parallel to, but generally spaced from, each other. One or more limbs is then inserted between and generally perpendicular to the stem wires. Next, a tubular spacing element is placed around the non-grasped ends of the stem wires and pushed toward the grasped ends of the stem wires, thereby also sliding the inserted limbs toward the grasped ends. This process of first inserting limbs and thereafter sliding tubular spacing elements is repeated until the tubular elements surround the stem throughout most of its length. The non-grasped ends of the stem wires are then grasped by a second chuck member, and the two chuck members are rotated with respect to each other, thereby intertwisting the stem wires to secure the limbs to the stem wires at longitudinally spaced positions defined by the tubular spacing elements.

Although the tree described in the above-identified patent constitutes a major advance in the art, it does suffer from the disadvantage that the tubular spacing elements and parts of the stem are visible to the eye to a great degree, thus detracting from the natural appearance of the shrub.

One attempt to improve the appearance of the stem is disclosed in U.S. Pat. No. 3,665,577, which is entitled "Apparatus For Manufacturing Artificial Shrubs" and which is hereby incorporated by reference. This patent discloses at least one narrow web which is inserted between and along the stem wires. As the stem wires are twisted, the web wraps spirally around the stem wires, thereby stimulating a tree trunk and additionally electrically insulating the limbs from the stem wires.

Another attempt to improve the appearance of the stem is disclosed in copending U.S. patent application Ser. No. 058,312, which is entitled "Artificial Tree and Method and Apparatus for Making Same", filed concurrently herewith by Si I. Spiegel, and Peter A. Circelli and now abandoned. The disclosure of this patent application is hereby incorporated by reference.

This application discloses the insertion of a plurality of bristles between the stem members. The stem members are twisted to capture the bristles thereby giving the stem and the resultant tree a fuller, more natural appearance.

The search has continued for new methods of providing artificial trees with fuller, more natural appearance. This invention was made as a result of that search.

OBJECTS AND SUMMARY OF THE INVENTION

Accordingly, a general object of the present invention is to avoid or substantially alleviate the above-mentioned problems of the prior art.

A more specific object of the present invention is to provide an artificial tree having a natural appearance.

Another object of the present invention is to provide an artificial tree wherein the intertwisted rods that form stems are not visible to the eye to an appreciable extent.

Yet another object of the present invention is to provide a method for manufacturing an artificial tree having a natural appearance.

Still another object of the present invention is to provide an apparatus for automatically and continuously manufacturing artificial trees having a natural appearance.

Other objects and advantages of the invention will become apparent from the following summary and description of the preferred embodiments of the present invention.

In one aspect, the present invention provides a method of manufacturing artificial trees of the type wherein a plurality of stiffly flexible stem members are intertwisted to capture stiffly flexible limb members. This method comprises:

(a) inserting the limb members between the stem members at spaced predetermined positions;
(b) placing a slitted web along the stem members; and
(c) intertwisting the stem members to capture the limb members at spaced longitudinal positions and to capture the slitted web.

In another aspect, the present invention provides an artificial tree comprising a plurality of stiffly flexible intertwisted wire rods, a plurality of limb assemblies formed of twisted wire and filament brush material, the limb assemblies carried by and extending generally orthogonally between the intertwisted wire rods at longitudinally spaced positions, and a slitted web intertwisted along the intertwisted wire rods. The slitted web imparts to the tree a fuller, more natural appearance.

In one embodiment of this aspect of the present invention, there is provided an artificial tree comprising a cylindrical trunk member with its axis generally oriented in a vertical direction, a plurality of branch assemblies comprising a stem having a hooked upper end and carrying at spaced longitudinal positions a plurality of limbs extending outwardly therefrom and further carrying a slitted web, and means carried by the trunk member for suspending the hooked stems circumferentially about the trunk member in a frustoconical array. Again, the slitted web imparts to the tree a fuller, more natural appearance.

In still another aspect of the present invention, there is provided an apparatus for automatically and continuously manufacturing artificial trees. This apparatus comprises:

(a) an endless feed conveyor for carrying at selected locations, a variable number of limb assemblies extending generally orthogonally to the direction of conveyor movement;
(b) a pair of wire guide pulleys disposed at the discharge end of the conveyor;
(c) means for feeding at least two stiffly flexible wires over and between the guide pulleys;
(d) means for introducing the limb assemblies between the stiffly flexible wires upon being discharged from the conveyor;
(e) means for introducing a slitted web between the stiffly flexible wires;
(f) means for intertwisting the wires to capture
  (1) the limb assemblies between the wires at spaced locations corresponding to the spacing of the limb assemblies on the conveyor, and
  (2) the slitted web;
(g) means for synchronizing movement of the intertwisted wires and the conveyor; and
(h) means for cutting the intertwisted wires into predetermined lengths to define an artificial tree.

DESCRIPTION OF THE PREFERRED EMBODIMENTS

Figure 1:
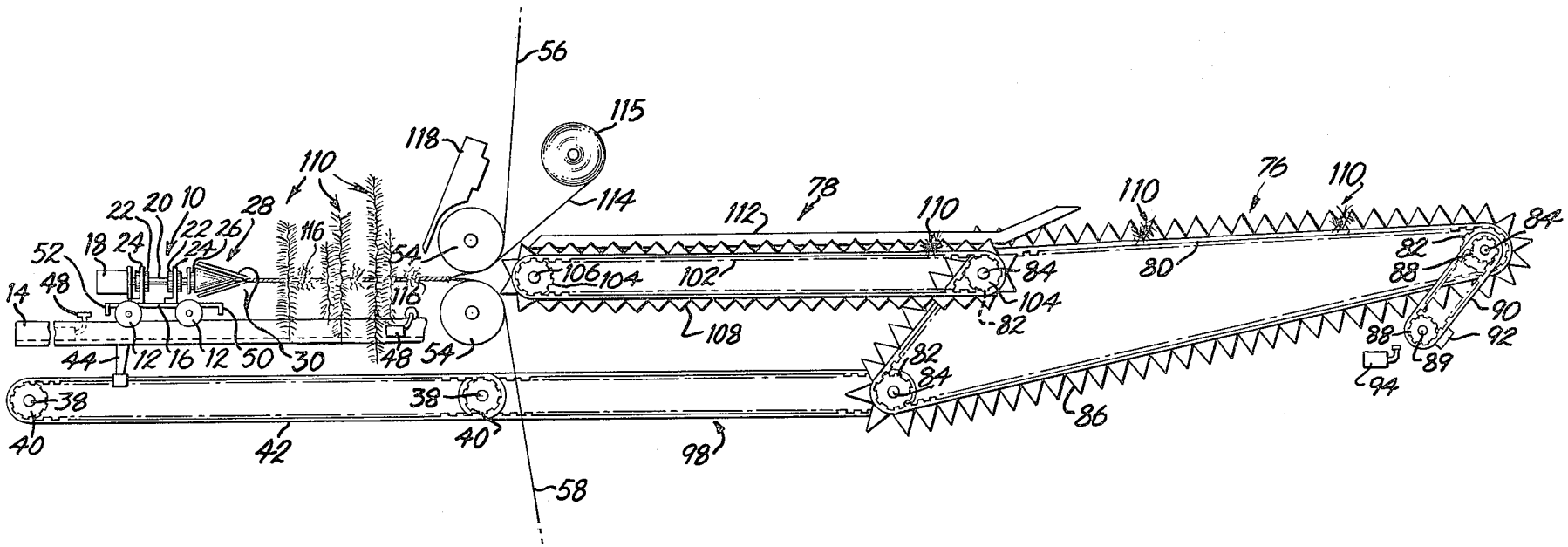
FIG. 1 is a schematic elevational view of the automated apparatus of the present invention.
Figure 2:
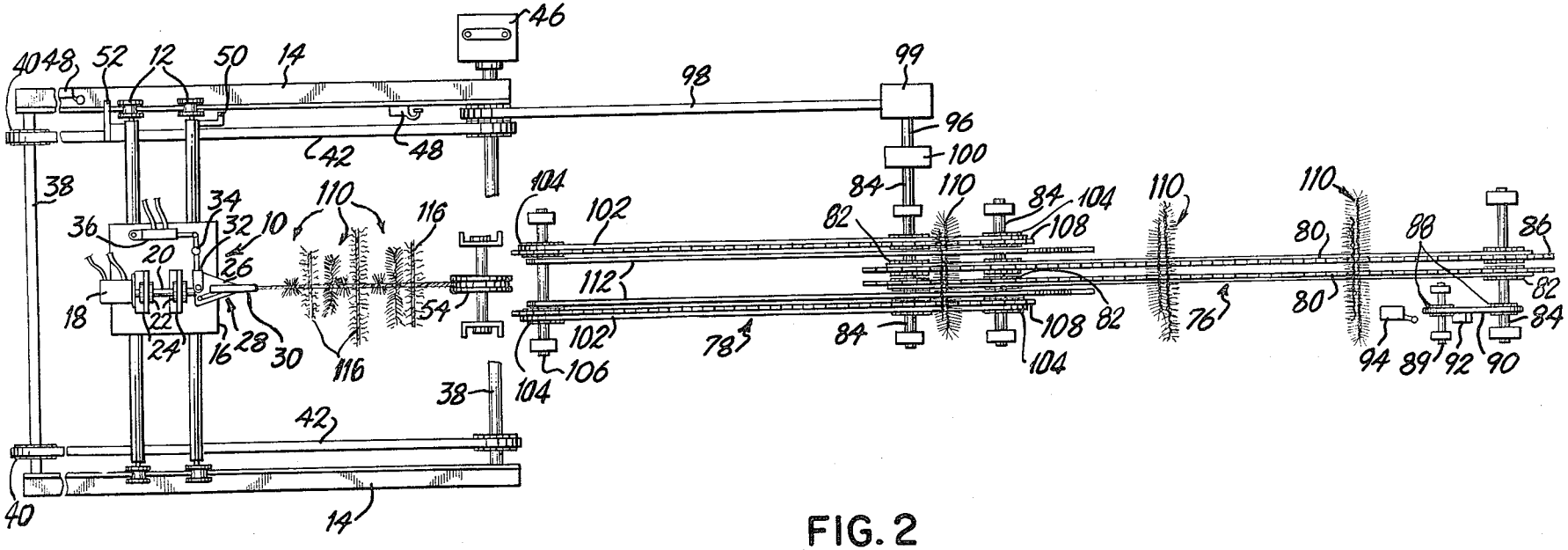
FIG. 2 is a top plan view of the apparatus shown in FIG. 1.

Referring now to the drawings, wherein like reference numerals refer to the same item, there is shown in FIG. 1 and FIG. 2 an apparatus for continuously and automatically manufacturing an artificial tree. The elements forming the apparatus are illustrated schematically with the means of supporting the elements in relation to other elements generally not shown.

The apparatus includes a carriage 10 having wheels 12 for reciprocally riding over a pair of horizontal, laterally spaced, L-shaped support rails or tracks 14. The wheels 12 are each provided with a peripheral groove to receive the upstanding edge of the corresponding track 14.

The carriage 10 comprises a base plate 16 to which the wheels 12 are attached and upon which is mounted a hydraulic or air motor 18. The motor 18 drives a rotatable shaft 20 which is suspended by bearings 22 carried by brackets 24 attached to the base plate 16. Coupled to the outer end of the shaft 20 is a freely axially slidably frustoconical member 26 which forms a portion of a rotatable chuck 28. The chuck 28 also includes a pair of chuck jaws 30 which are pivotably mounted on the shaft 20. The frustoconical member 26 is provided with a peripheral groove for receiving the opposed ends of a yoke 32. The yoke 32 is pivotably mounted about a vertical axis as defined by a pin 34 supported by the base plate 16. The yoke 32 is also attached to the shaft of a reciprocating hydraulic motor 36 also supported by the base plate 16 so that by energizing the reciprocating hydraulic motor 36, the yoke 32 is pivoted about the pin 34, thereby causing longitudinal movement of the frustoconical member 26 along the shaft 20. Movement of the frustoconical member 26 in turn causes opening and closing of the chuck jaws 30. The reciprocating carriage 10 and the rotatable chuck 28 are similar to those described in U.S. Pat. No. 3,223,454.

A pair of rotatable shafts 38 are mounted laterally beneath the tracks 14, each shaft 38 carrying a pair of sprockets 40 and each sprocket 40 generally located beneath an end of one of the tracks 14. The sprockets 40 in turn carry a pair of endless chains 42 located beneath and parallel with the tracks 14. A link in each of the chains 42 is fixedly coupled to the carriage base 16 via a corresponding coupling member 44 whereby movement of the chains 42 will effectuate a corresponding movement of the carriage 10 along the tracks 14.

The chains 42, and consequently the carriage 10, are driven by a hydraulic motor 46 acting on and selectively rotating one of the shafts 38. Movement of the carriage 10 along tracks 14 is limited by a pair of microswitches 48 adjustably positioned on the tracks 14. The microswitches 48 are activated by contact with abutment prongs 50, 52 projecting from the carriage 10 so that upon activation of one of the microswitches 48 the action of hydraulic motor 46, and consequently the direction of carriage travel, is reversed. At the same time, the motor 18 and the motor 36 are selectively activated to cause selective rotation of the chuck 28 and opening of the chuck jaws 30.

Upon contact of the abutment prong 52 with the appropriate microswitch 48, the chuck jaws 30 open and remain open while the carriage 10 travels from left to right as viewed in FIG. 1. Upon contact of the abutment prong 50 with the appropriate microswitch 48, the chuck jaws close and remain closed and additionally rotate while the carriage 10 travels from right to left as viewed in FIG. 1.

At one end of the tracks 14, a pair of wire guide pulleys 54, one pulley being vertically disposed above the other and each having a peripheral groove, are mounted for free rotation about their respective axes. Two stiffly flexible wires 56,58 are each fed around and through the peripheral groove of a corresponding pulley 54 to the chuck jaws 30 on the carriage 10. The wires 56,58 may be pretreated with paint prior to being fed through the pulleys 54.

Figure 3:
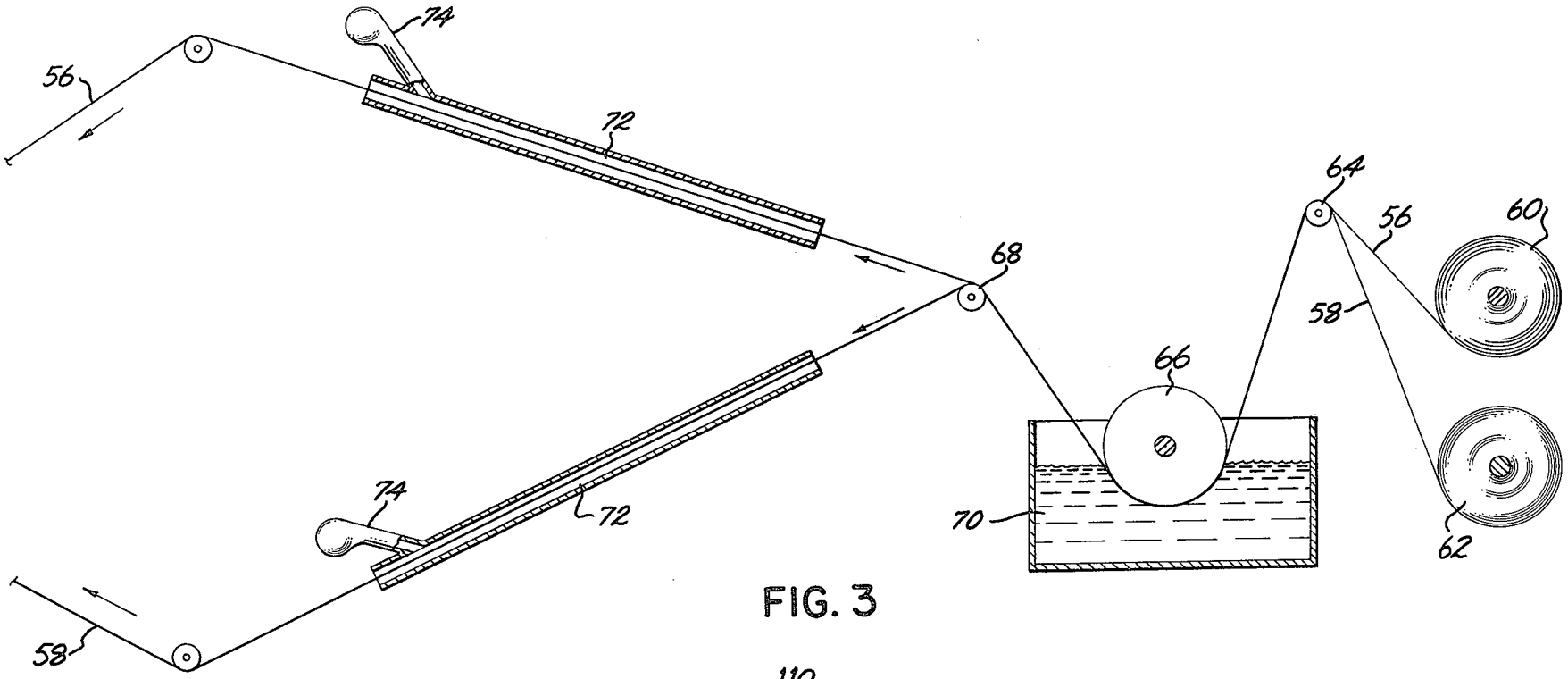
FIG. 3 is a schematic diagram of means for treating wire and feeding wire to the apparatus shown in FIG. 1.

As shown in FIG. 3, the wires 56,58 are each fed from a corresponding wire supply reel 60,62 over and around a series of rollers 64,66,68. One of the rollers 66 is partially immersed in a bath of paint 70, preferably colored green, so that the wires 56,58 are coated with paint. After passing through the series of rollers 64,66,68, each wire 56,58 is separately drawn through a corresponding drying tube 72, preferably without contacting the interior walls of the tube. The interior of each tube 72 communicates with the output of an air heater/compressor unit 74, which may be constructed like a common blow dryer for human hair and which blows heated air through the drying tube 72, thereby hardening and drying the paint on the wires 56,58.

The present invention is particularly directed to the automatic feeding of limbs of predetermined, varying length and in predetermined, varying number between the wires 56,58 at predetermined, spaced longitudinal positions. To effectuate such feeding, the apparatus as shown in FIG. 1 and FIG. 2 includes a limb delivery conveyor 76 and a limb feed conveyor 78.

The delivery conveyor 76 includes two endless chains 80 carried by three pairs of sprockets 82, each pair of sprockets 82 being commonly mounted on a corresponding shaft 84 (one sprocket of each pair not being shown). Each endless chain 80 carries a series of teeth 86, with each tooth 86 having a corresponding tooth 86 directly laterally opposite on the other endless chain 80, thereby defining a flight.

On one of the three shafts 84 is mounted one of a pair of timing chain sprockets 88, the other timing chain sprocket 88 being mounted on yet another shaft 89. The timing chain sprockets 88 carry an endless timing chain 90 to which is attached a cam 92. Movement of the timing chain 90 around the timing chain sprockets 88 causes the cam 92 to activate a fixed position microswitch 94.

Another of the three shafts 84 is coupled for selective rotation with one of the carriage shafts 38. To accomplish such rotation, one of the carriage shafts 38 carries one of a pair of conveyor drive sprockets (not shown), the other conveyor drive sprocket being carried by a selectively rotatable conveyor drive shaft 96 and the two conveyor drive sprockets in turn carrying an endless conveyor drive chain 98 for common rotation. The selectively rotatable conveyor drive shaft 96 may be caused to selectively rotate with the conveyor drive sprocket mounted thereon, and consequently to selectively rotate with the carriage shafts 38, through the use of an electric clutch 99 responsive to the microswitch 94, and is coupled to the appropriate shaft 84 for rotation therewith through a transmission 100. The endless chains 80 of the delivery conveyor 76 are thereby caused to selectively rotate with the carriage shafts 38.

The feed conveyor 78 includes two endless belts 102 carried by two pairs of sprockets 104, one pair of sprockets 104 being mounted on a shaft 106 disposed near the nip area between the pulleys 54 and having its axis parallel with the pulleys axes, and the other pair of sprockets 104 being mounted on the third of the three delivery conveyor shafts 84, outside of the other two sprockets 82 (not shown) also mounted thereon. Each endless chain 102 carries a series of teeth 108, with each tooth 108 having a corresponding tooth 108 directly laterally opposite on the other endless chain 102, thereby defining a flight. Because one of the shafts 84 has commonly mounted thereon sprockets 82 carrying the endless chains 80 of the delivery conveyor 76 and sprockets 104 carrying the endless chains 102 of the feed conveyor 78, the two conveyors 76,78 simultaneously rotate.

In operation, a number of limbs 110 of predetermined, varying lengths are placed laterally across the endless chains 80 of the delivery conveyor 76 and are stacked between the teeth 86 of adjacent flights. Other limbs 110 may be placed at predetermined, varying distances along the endless chains 80 of the delivery conveyor 76 between the teeth 86 of adjacent flights.

Figure 4:
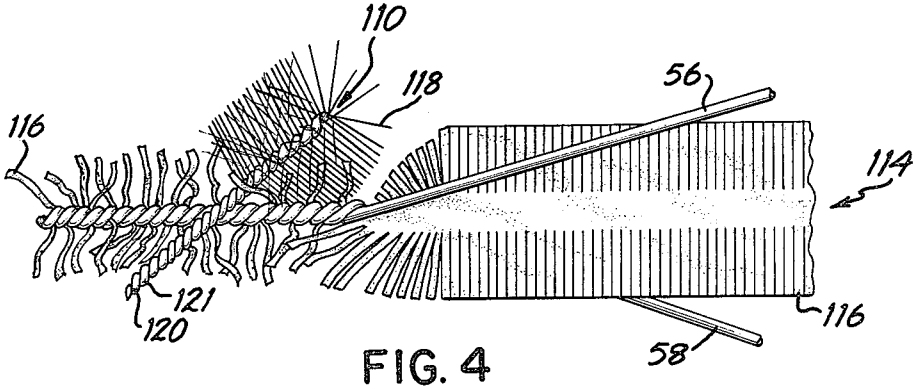
FIG. 4 is a side elevational perspective view illustrating the formation of the artificial tree by intertwisting wires.
Figure 5:
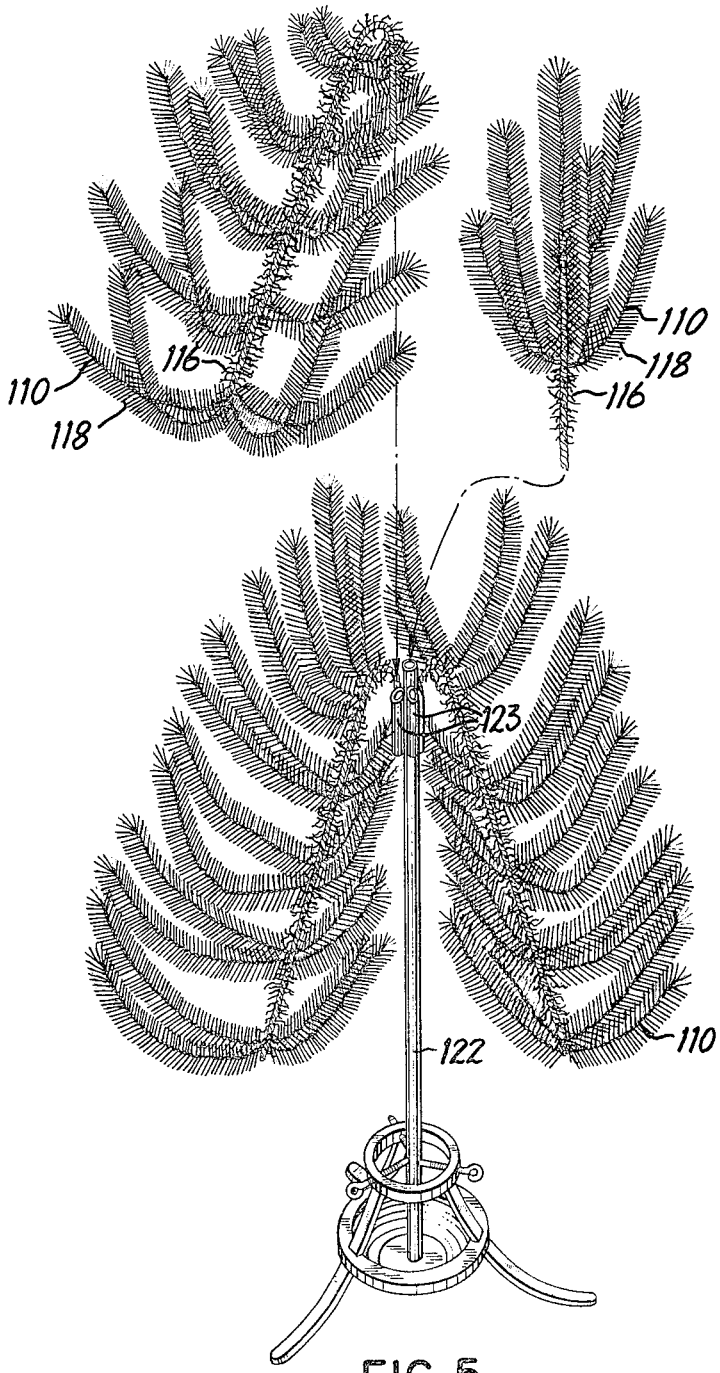
FIG. 5 is an exploded, perspective view of an alternate embodiment of the artificial tree.

As can be best understood by referring to FIG. 4 and FIG. 5, each limb 110 comprises a plurality of filaments or "brush stock" 118 radially extending from and between two intertwisted wires 120, 121 near the ends thereof.

As can best be understood by again viewing FIG. 1, the delivery conveyor 76 moves the limbs 110 toward the feed conveyor 78. Upon nearing the feed conveyor 78, the limbs 110 are compressed downwardly toward the endless chains 80 by a pair of guides 112 located generally slightly above the endless chains 102 of the feed conveyor 78 and generally parallel therewith. The delivery conveyor 76 transfers the limbs 110 to the feed conveyor 78 where the limbs 110 are deposited laterally across the endless chains 102 of the feed conveyor 78 between teeth 108 of adjacent flights. The guides 112 maintain the limbs 110 in a compressed condition as they travel along the feed conveyor 78. The limbs 110 are discharged from the feed conveyor 78 in the nip area between the pulleys 54 such that they lie between the wires 56, 58.

Also inserted between and along the wires 56,58 in the nip area is a web or narrow band 114 having a series of generally lateral slits therein along both edges thereof. As can be seen in FIG. 4, the web 114, which is preferably of continuous length and rolled on a spool 115, has a series of frills 116 along each edge and a non-slitted center portion, thereby giving the web 114 a feathered or slitted appearance. Although the frills 116 may be along only one edge of the web 114, it is preferable that both edges are frilled. Also the web 114 is preferably composed of polyvinyl chloride or other plastic, preferably 3 inches wide and 3 mils thick, preferably colored green, and the slits therein are preferably normal to the web length. The web 114 may be slitted by any apparatus known to those skilled in the art for that purpose, particularly the apparatus described in U.S. Pat. No. 3,548,694, the disclosure of which is hereby incorporated by reference.

The previous discussion demonstrates that the movements of the carriage 10, the chuck jaws 30, and the conveyors 76,78 are synchronized so that the chuck 30 grasps the wires 56, 58 and the web 114 near the nip area and then the chuck jaws 30 pull away from the nip area while simultaneously rotating, thereby causing the wires 56, 58 and the web 114 to intertwist as they move away from the nip area as shown in FIG. 4. At the same time, the feed conveyor 78 deposits limbs 110 varying in number and length between the wires 56, 58 in the nip area. Since the limbs 110 were placed in predetermined locations along the delivery conveyor 76, the limbs 110 will be delivered between the wires 56, 58 at varying times, thereby causing the limbs 110 to be captured by and to extend generally perpendicularly between the wires 56, 58 in predetermined, spaced longitudinal positions as the wires 56, 58 are twisted with the web 114.

When the carriage 10 has traveled away from the nip area so that the abutment prong 52 contacts the appropriate microswitch 48, the conveyors 76,78 are stopped and the wires 56,58 and the web 114 are severed near the nip area by a cutter 118 slanted slightly away from vertical above the wires 56, 58. The slanting of the cutter 118 helps prevent unraveling of the ends of the wires 56,58 and the web 114 as they are cut. Also, the cutter 118 is positioned such that after cutting, the wires 56,58 and the web 114 are twisted for a short distance between the nip area and the place of cutting. This permits the chuck jaws 30 to easily grasp the wires 56,58 and the web 114 for the next run of the carriage 10.

The severed portion of the wires 56,58 and the web 114, which carries a plurality of limbs 110 of predetermined, varying numbers perpendicularly extending therebetween at predetermined, spaced, longitudinal positions therealong, comprises a single artificial tree.

From FIG. 4 and FIG. 5, it can be seen that the intertwisted wires 56,58 and the web 114 form a sort of stem, with the frills 116 of the web 114 radially extending from the stem and the center portion of the web 114 covering a portion of the wires 56,58, thereby hiding the wires 56,58 and giving the stem a full, natural appearance. By varying the position of the microswitches 48, artificial trees may be made of differing (item) lengths.

In FIG. 5, there is shown a generally vertically extending, cylindrical trunk member 122 supporting a plurality of relatively short tubular members 123 about the circumference thereof, near the upper end thereof, with their axes generally parallel with the trunk member 122. One end of the stem of each of a plurality of branches is bent in a hook shape and inserted in a corresponding short tubular member 123 such that the branches are suspended circumferentially about the trunk member 122 in a frustoconical array. The limbs 110 on the branches may be bent to point generally radially with respect to the trunk member 122. Also, the upper end of each short tubular member 123 may be beveled to prevent rotation of the branch with respect to same. Furthermore, a generally conically shaped branch having no hooked stem may have a stem end inserted in the open, upper end of the trunk member 122 thereby forming a conically shaped artificial tree.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in this art without departing from the spirit or scope of the invention.

We claim:

1. An artificial tree comprising a cylindrical trunk member with its axis generally oriented in a vertical direction, a plurality of branches formed of stiffly flexible intertwisted wire rods, a plurality of limb assemblies formed of twisted wire and filament brush material, said limb assemblies carried by and extending generally orthogonally between said intertwisted wire rods at longitudinally spaced positions, and a slitted web intertwisted along said intertwisted wire rods, said web imparting to said tree a fuller, more natural appearance, and said intertwisted rods being attached to said trunk member.

2. The artificial tree of claim 1 wherein the radially extending limb assemblies have portions extending on either side of said intertwisted wire rods with the section of said radially extending limb assembly in contact with said intertwisted wire rods being free of filament brush material to facilitate reception of said slitted web.

3. An artificial tree comprising a cylindrical trunk member with its axis generally oriented in a vertical direction, a plurality of branch assemblies, each branch assembly comprising a stem having a hooked upper end, a plurality of stiffly flexible intertwisted wire rods, a plurality of limb assemblies formed of twisted wire and filament brush material, said limb assemblies carried by and extending generally orthogonally between said intertwisted wire rods at spaced longitudinal positions and said intertwisted wire rods further carrying a slitted web, and means carried by said trunk member for suspending said hooked stems circumferentially about said trunk member in a frustoconical array, said slitted web imparting to the tree a fuller, more natural appearance.

4. The tree of claim 3 wherein the limb assemblies are substantially of the same length.

5. The tree of claim 3 wherein said means for suspending said branch assemblies comprises a plurality of short tubular members circumferentially spaced about and supported by said trunk member with the axes of said tubular members being generally parallel to the axis of said trunk member.

6. The tree of claim 3 wherein said trunk member comprises a metal tube and the tree further comprises a conical top, part of the top being adapted for reception in the open upper end of said tubular trunk member.

7. The tree of claim 5 wherein the upper end of each of said short tubular members is beveled for preventing rotation of said hooked ends of said stem assemblies.

* * * * *